United States Patent [19]

Matsumoto et al.

[11] Patent Number: 4,719,784

[45] Date of Patent: Jan. 19, 1988

[54] ROLL BENDING APPARATUS FOR ROLLING MILL

[75] Inventors: Kouichi Matsumoto; Masahiro Hayashi; Toshiyuki Kajiwara, all of Hitachi, Japan

[73] Assignee: Hitachi, Ltd., Tokyo, Japan

[21] Appl. No.: 847,489

[22] Filed: Apr. 3, 1986

[30] Foreign Application Priority Data

Apr. 3, 1985 [JP] Japan ..... 60-70643

[51] Int. Cl.[4] ..... B21B 29/00; B21B 31/08; B21B 31/32

[52] U.S. Cl. ..... 72/242; 72/238; 72/243; 72/245; 72/247

[58] Field of Search ..... 72/241, 245, 242, 243, 72/237, 238, 239, 247

[56] References Cited

U.S. PATENT DOCUMENTS

| | | | |
|---|---|---|---|
| 3,003,373 | 10/1961 | Volkhausen | 72/243 |
| 4,369,646 | 1/1983 | Kajiwara | 72/243 |
| 4,539,834 | 9/1985 | Iwanami | 72/243 |
| 4,543,810 | 10/1985 | Stoy et al. | 72/243 X |
| 4,563,888 | 1/1986 | Bald et al. | 72/243 |
| 4,577,480 | 3/1986 | Kizaki et al. | 72/243 X |
| 4,598,566 | 7/1986 | Bald et al. | 72/243 |

FOREIGN PATENT DOCUMENTS 166306 9/1984 Japan .

*Primary Examiner*—Robert L. Spruill
*Assistant Examiner*—Steve Katz
*Attorney, Agent, or Firm*—Fay, Sharpe, Beall, Fagan, Minnich & McKee

[57] ABSTRACT

A roll bending apparatus for use in a multi-stage rolling mill adapted for rolling a hard material or a thin sheet material with a high uniformity of thickness along the breadth, with a high degree of accuracy and low energy. The rolling mill has work rolls of a comparatively small diameter. The amount of bend of the small-diameter work roll is controlled by the roll bending apparatus for attaining the high degree of uniformity of thickness along the breadth of the rolled material. The roll bending apparatus has, for each of said work rolls, a supporting member having a work roll supporting portion for rotatably supporting the work roll and rockable vertically about a fulcrum, and a bending force generating means adapted for engaging the supporting member so as to cause a rocking motion of the supporting member thereby applying a substantially vertical roll bending force to the work roll through the supporting member.

13 Claims, 13 Drawing Figures

ROLL BENDING APPARATUS FOR ROLLING MILL

BACKGROUND OF THE INVENTION

Field of the Invention

The present invention relates to a multi-stage rolling mill having work rolls of a comparatively small diameter and, more particularly, to a roll bending apparatus for imparting a bend to the work rolls of small diameter in a multi-stage rolling mill.

In the fields of rolling mills, there is an increasing demand for saving of energy and reduction in the generation of edge drop. In particular, rolling mills for rolling web materials such as thin and wide sheets, as well as sheets of a high hardness, are required to provide a high degree of uniformity of thickness along the breadth of the sheet. In order to meet such demands, it has been proposed to reduce the diameter of the work rolls as much as possible, so as to enable a crown control, i.e., the control of deflection of the work rolls, by work roll bending apparatus which imparts a controlled bend to each work roll. The work roll bending apparatus is usually installed in a space between back-up roll chocks which support both ends of upper and lower back-up rolls which back up upper and lower work rolls, respectively. Thus, an extremely small diameter of the work rolls makes it difficult to find the space for the installation of the work roll bending apparatus, because in such a case the vertical distance between both back-up roll chocks is very small.

On the other hand, the reduced diameter of the work rolls lowers the flexural rigidity of the work roll, so that the work rolls tend to deflect in the horizontal directions, causing unfavourable effect on the cross-section of the rolled product. Thus, a reduction in the diameter of work rolls in turn requires both a reduction in the size of the work roll bending apparatus and a supporting mechanism which prevents horizontal deflection of the work rolls.

A prior art shown in the specification of the U.S. Pat. No. 4,369,646 has roll bending apparatus for work rolls and also roll bending apparatus for upper and lower intermediate rolls which back up the work rolls. These roll bending apparatus, however, cannot be used practically when the diameter of the work rolls is further decreased.

On the other hand, rolling mills are recently developed which have both the supporting mechanism for preventing horizontal deflection of the work rolls and roll bending apparatus for work rolls. A four-stage rolling mill as an example of such rolling mills is shown in U.S. Pat. No. 4,598,566. In this rolling mill, each of the bearing boxes for the work roll is supported in the following manner. Namely, each of the work roll chock which rotatably supports one end of a work roll is secured to a supporting member through a pair of guides which engage with both sides of the work roll chock. Thus, almost no play or gap is formed between each guide member and the work roll chock nor between each guide member and the supporting member. This imposes the following problem.

The work roll is progressively worn during long rolling operation, so that the work rolls are periodically replaced and the surfaces of the demounted work rolls are ground further use. In consequence, the diameter of the work roll is gradually decreased. On the other hand, in order to prevent undesirable horizontal deflection of the work roll, it is necessary that the support roll of the mechanism for preventing the horizontal deflection is held in contact with the work roll. However, when the work roll diameter has been decreased as a result of repeated grinding, it becomes materially impossible to keep the support roll in contact with the work roll, because no substantial play or gap exists in the structure which supports the work roll chock. In consequence, a slight gap is left between the work roll and the support roll, so that the work roll is deflected horizontally, with a result that the quality of the rolled product is impaired seriously.

The rolling mill disclosed in U.S. Pat. No. 4,598,566 incorporates a work roll bending apparatus which is adapted to impart the bending force to the work roll by means of a lever which is swingable about a fulcrum. The swinging motion of the lever is caused by a cylinder which is disposed on the same side of the fulcrum as the work roll. This roll bending apparatus has quite a complicated construction which can hardly be made compact.

SUMMARY OF THE INVENTION

Accordingly, an object of the invention is to provide a roll bending apparatus for work rolls in a rolling mill of the type in which work rolls of a small diameter and the supporting structure for rotatably supporting these work rolls are constructed as separate parts.

To this end, according to an aspect of the invention, there is provided a roll bending apparatus for a small-diameter work roll of a rolling mill, the apparatus comprising: a rockable support member which is rockable around a fulcrum, the support member being provided at one side of the fulcrum with a work roll supporting portion which rotatably supports one end of a work roll, and a bending force generating means engaging with a portion of said support member on the opposite side of the fulcrum to the roll supporting portion, such that said support member is rotated about said fulcrum so as to apply a bending force to the work roll.

DESCRIPTION OF THE PREFERRED EMBODIMENTS

The roll bending apparatus of the invention is adapted to be used in a rolling mill which has a construction substantially the same as that shown in the specification of the U.S. Pat. No. 4,369,496. Namely, the rolling mill has upper and lower work rolls for rolling the material, upper and lower intermediate rolls for supporting the upper and lower work rolls, and upper and lower back-up rolls which back up the upper and lower intermediate rolls. The rolling mill further has roll bending apparatus for intermediate rolls or, alternatively, roll bending apparatus both for the intermediate rolls and the work rolls, and a shifting device for axially shifting the upper and lower intermediate rolls.

In operation, the axial position of the intermediate rolls and the states of the intermediate roll bending apparatus or, alternatively, both the intermediate roll bending apparatus and the work roll bending apparatus are suitably controlled in accordance with the rolling conditions such as the change in the breadth of the rolled sheet, thickness distribution along the breadth and the state of the surface of the rolled material, thereby rolling a thin sheet or a sheet of a hard material at a high precision. The problems incurred during the rolling and the measures for overcoming the problems are described in the specification of the U.S. Pat. No. 4,369,646 mentioned before, so that a reference shall be made to this literature.

A preferred embodiment of the roll bending apparatus of the invention will be explained hereinunder with reference to the accompanying drawings.

Figure 11:
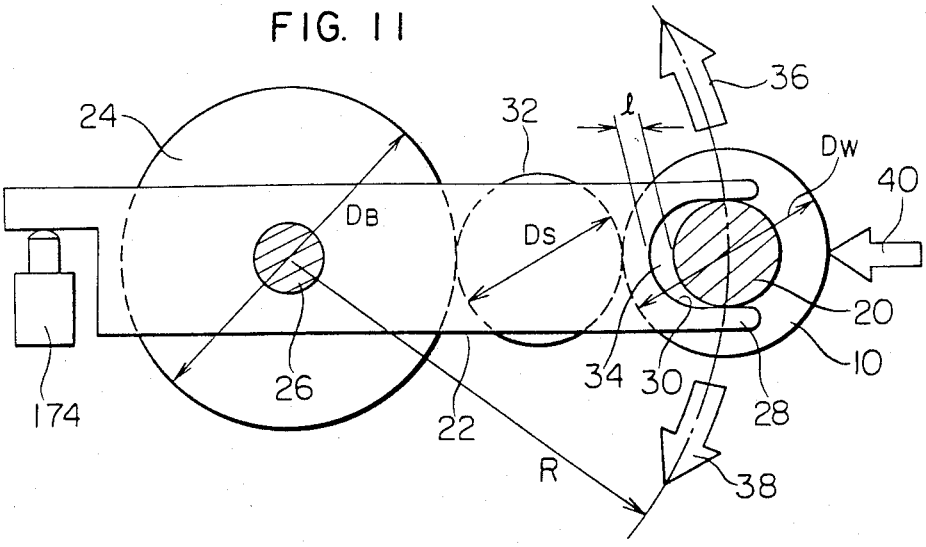
FIGS. 11 to 13 are schematic illustration of the basic concept of the roll bending apparatus of the invention.

FIG. 11 schematically shows the basic concept of the roll bending apparatus of the invention.

Referring to FIG. 11, a work roll 10 is supported by a pair of supporting arms 22 through respective bearings 20. The arms 22 are rockably supported by a segmented roller support shaft 26 which supports a segmented roller 24 for adjusting the crown of the work roll. The arm 22 has an end which is notched so as to form a fitting recess 30. This end of the arm 22 constitutes a work roll supporting portion 28 which supports the work roll 10 through the work roll bearing 20. The portion of the arm 22 between the work roll supporting portion 28 and the segmented roll support shaft 26 constitutes a support roll supporting portion which supports one end of the support roll 32. As will be understood from FIG. 11, the fitting recess 30 is so shaped and sized that a gap 34 is left between the wall of the recess 30 and the work roll bearing 20, when the work roll 10 and the support roll 32 are still new. The size "l" of this gap 34 is determined in accordance with various factors such as the diameter of the work roll, amount of grinding of the work roll, and so forth.

The bending force generating device 174, which is adapted to impart a bending force to the work roll 10, engages with the end of the arm 22 adjacent the segmented roller support shaft 26 which constitutes the fulcrum for the arm 22. The roll bending force 36, 38 is applied, therefore, in the form of a moment having an arm length R which is given by the following formula:

$$R = D_W/2 + (D_S \times \text{number of support rolls}) + D_B/2$$

where, $D_W$ represents the work roll diameter, $D_S$ represents the support roll diameter, and $D_B$ represents the segmented roll diameter.

The gap 34 formed between the bottom of the recess 30 and the work roll bearing 20 serves to maintain the contact between the work roll 10 and the support roll 32, when the work roll diameter has been decreased as a result of, for example, grinding of the surface of the work roll, because the work roll bearing 20 can move leftward as viewed in FIG. 11 so as to keep the work roll 10 in contact with the support roll 32. Therefore, the undesirable horizontal deflection of the work roll 10 is prevented even when a horizontal force is applied as indicated by an arrow 40. In addition, the escape or forcible movement of the support roll 32 upward or downward from the illustrated position is avoided because the axes of the work roll 10, support roll 32 and the segmented roll 24 are arranged on a straight line, so that the work roll 10 can be supported without fail. It will be clear to those skilled in the art that the recess 30 can be substituted by an elongated hole. It will be clear also that the bearing 20 supporting the work roll may be a plain bearing.

Figure 12:
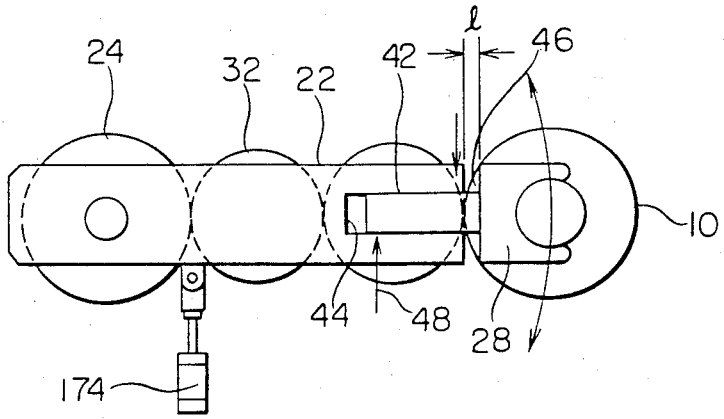

FIG. 12 shows an example in which the work roll supporting portion 28 is formed as a separate member. The work roll supporting portion 28 is provided on the left end thereof as viewed in FIG. 12 with an insert projection 42 which is adapted to be received in a hole 44 formed in the arm 22. The work roll supporting portion 28 is so shaped and sized that, when the insert projection 42 thereof is received in the hole 44 with the work roll 10 held in contact with the support roll 32, a gap of a size "l" is left between the work roll supporting portion 28 and the arm 22. The insert projection 42 resists, as indicated by an arrow 48, any force which tends to cause a rotation of the work roll supporting portion 28 relative to the arm 22, when the bending force is applied to the work roll 10 by the bending force generating device 174.

Figure 13:
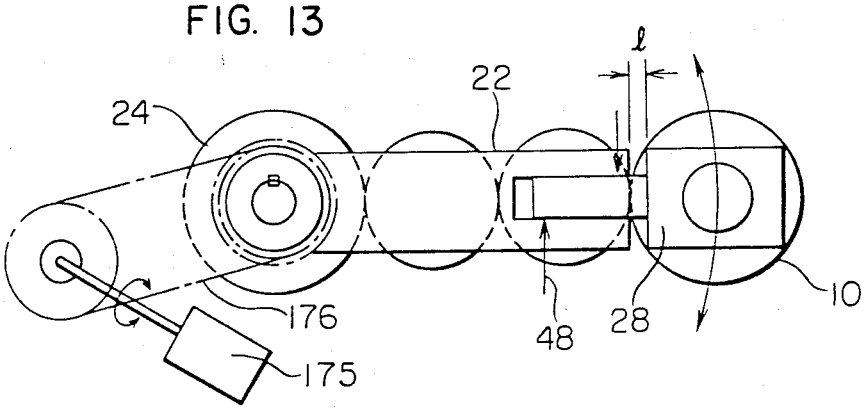

FIG. 13 shows an arrangement which is similar to that shown in FIG. 12, except that the end of the work roll supporting portion 28 is devoid of the notch. The bending moment is transmitted to the arm 22 through a chain 176 which in turn is driven by a suitable driving device 175.

An embodiment of the roll bending apparatus of the invention will be described hereinunder with reference to FIGS. 1 to 10.

Figure 1:
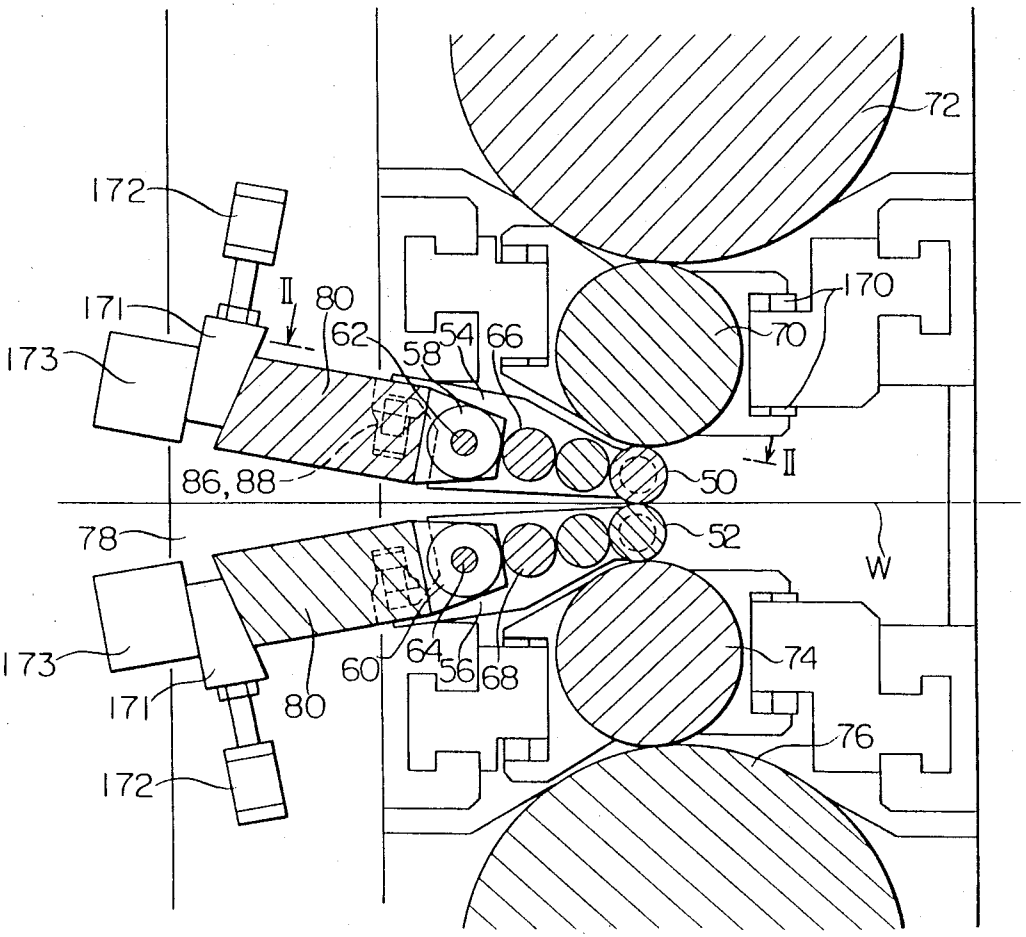
FIG. 1 is a front elevational view of a rolling mill provided with an embodiment of the roll bending apparatus in accordance with the invention.

FIG. 1 is a front elevational view of an essential portion of a rolling mill having a roll bending apparatus in accordance with the invention. The upper work roll 50 and the lower work roll 52 are rotatably supported by ends of an upper support arm 54 and a lower support arm 56, respectively. The work rolls 50, 52 have such a diameter $D_W$ that the ratio of the diameter $D_W$ to the maximum breadth B of the rolled material, i.e., work W is 0.2 or smaller. Namely, the condition of $D_W/B$=about 0.2 is met. The upper and lower support arms 54 and 56 are rotatably carried by the support shafts 62, 64 which support upper and lower support arms 54, 56, respectively. The upper support arm 52 supports two upper support rolls 66, 66 at its portion between the work roll 50 and the upper segmented roll 58. The axes of the rolls carried by the upper support arm and the axis of the upper segmented roll 58 are disposed on a common straight line. On the other hand, the lower support arm 56 supports the lower support rolls 68, 68. The axes of the rolls on the lower support arm 56 and the axis of the lower segmented roll 60 are arranged on a same straight line.

An upper intermediate roll 70 and an upper back-up roll 72 are disposed on the upper side of the upper work roll 50, whereas a lower intermediate roll 74 and a lower back-up roll 76 are arranged on the lower side of the lower work roll 52. The axes of the upper and lower work rolls 50, 52 are disposed on the left side of the axes of respective intermediate rolls 70, 74 as viewed in the drawings. The axes of the upper and lower intermediate rolls 70, 74 are disposed on the left side of the axes of the upper and lower back-up rolls 72, 76 as viewed in the drawings. In consequence, the forces applied by the upper and lower back-up rolls 72, 74 to the upper and lower work rolls 50, 52 through the upper and lower intermediate rolls 70, 74 produce force components which act to press the upper and lower work rolls 50, 52 towards the upper and lower support rolls 66, 68, respectively.

Thus, the arrangement in connection with the lower work roll 52 is materially identical to that concerning the upper work roll 50. The following description, therefore, will be made mainly in connection with the upper work roll 50.

Figure 2:
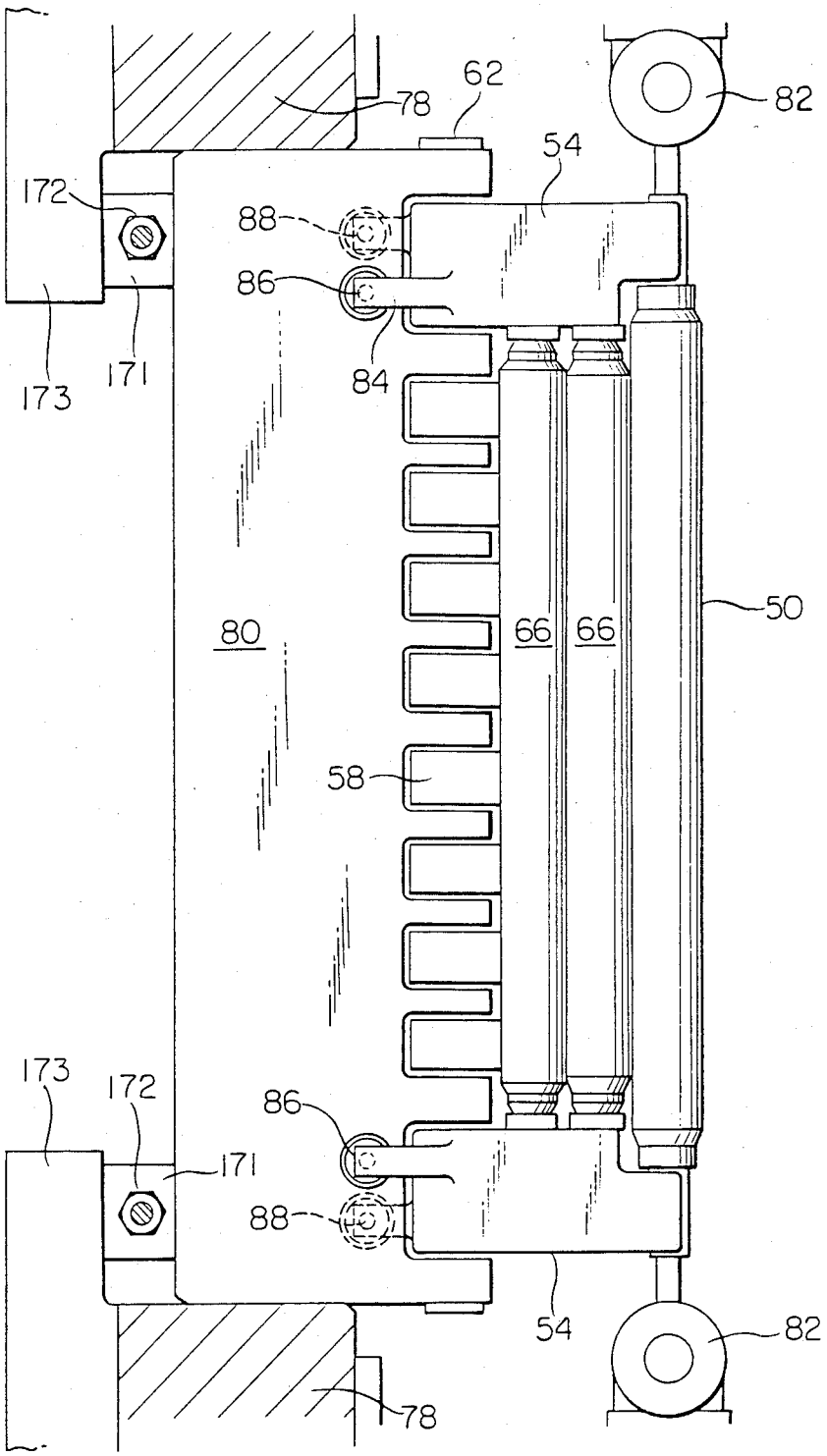
FIG. 2 is a view taken in the direction of arrows II—II of FIG. 1.

As will be seen from FIG. 2, the support shaft 62 of the upper segmented roll 58 is fixed to the support beam 80 provided on the mill housing 78. Thrust bearings 82 are provided on both ends of the upper work roll 50, separately from the upper support arm 54. The thrust bearing 82 is secured to a door (not shown) which is provided in the mill housing 78 and opened only when the rolls are exchanged. Thus, the thrust bearings 82 transmit the thrust force acting on the upper work roll 50 to the door. A wedge 171 and a block 173 are jointed to both ends of the support beam 80. An actuator cylinder 172 is drivingly connected to each wedge 171, so that the position of the support beam 80 in relation to the blocks 173 is adjustable by means of the cylinders 172. Engaging portions 84 are formed on the upper and lower ends of the rear end portion of each upper support arm 54. Bending cylinders 86, 88 have piston rods which engage with the engaging portions 84. Namely, the bending cylinder 86 is disposed on the support beam 80 such that its piston rod projects upwardly, while the bending cylinder 88 is disposed on the support beam 80 such that its piston rod projects downwardly. Obviously, the pair of bending cylinders 86, 88, both of which are single-acting cylinders, may be substituted by a double-acting cylinder.

Figure 3:
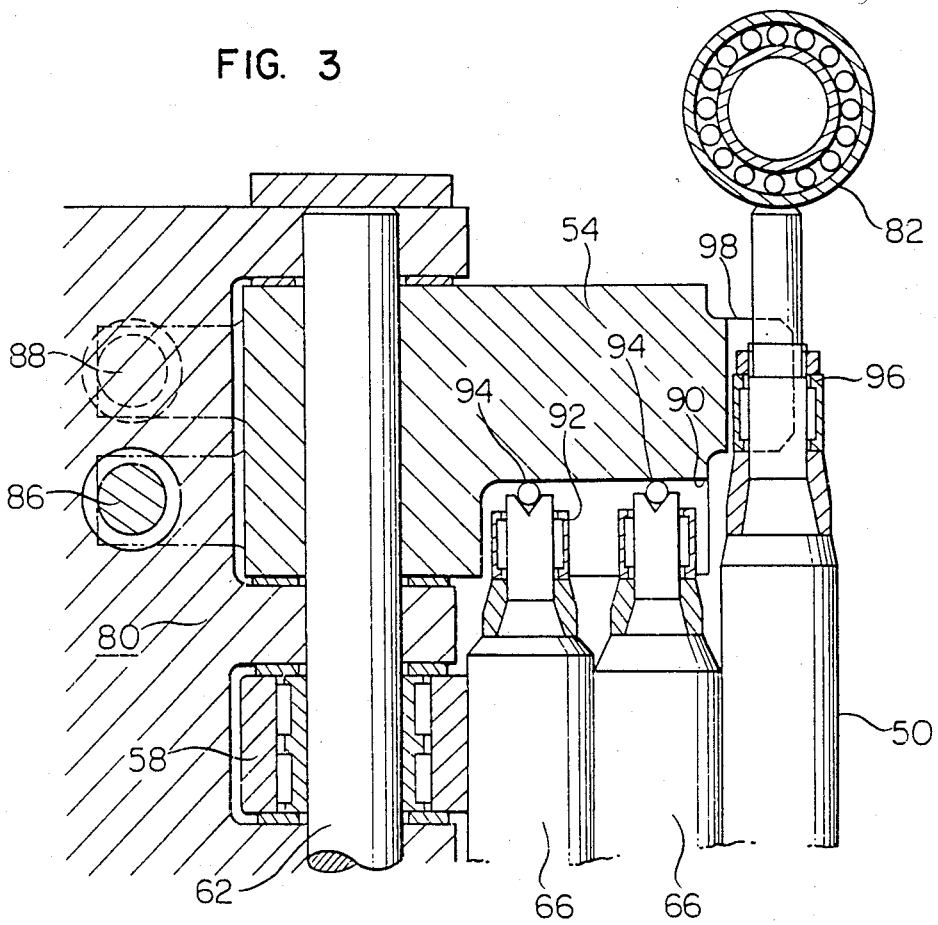
FIGS. 3 and 4 are illustrations of an upper support arm which is in support of a work roll.
Figure 4:
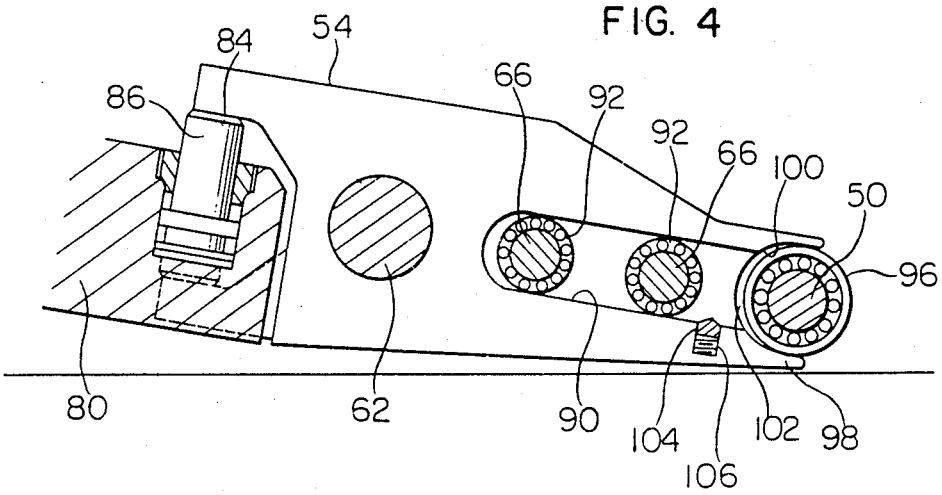
Figure 6:
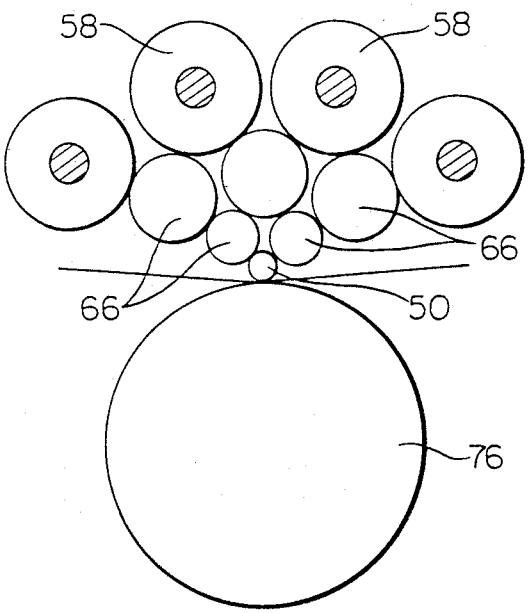
FIGS. 6 to 10 are schematic illustrations of different rolling mills to which the roll bending apparatus of the invention can be applied.
Figure 7:
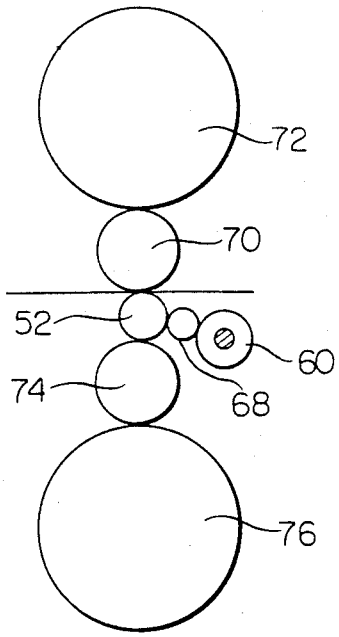
Figure 8:
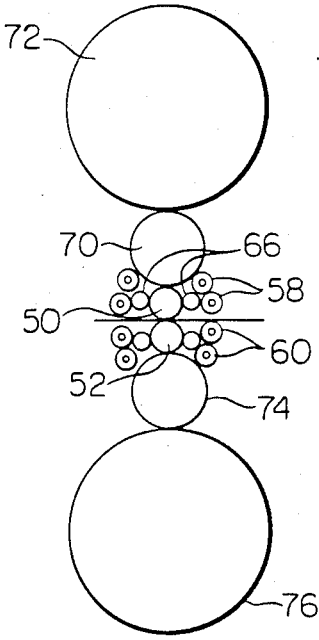
Figure 9:
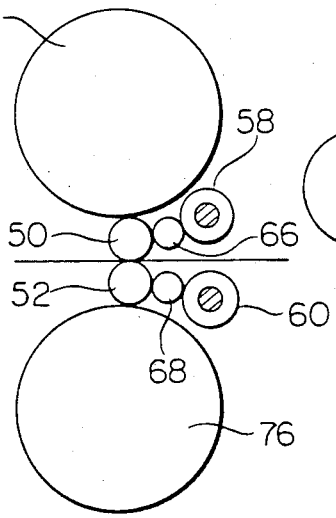
Figure 10:
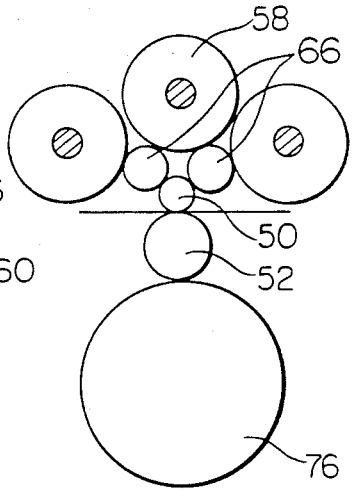

As shown in FIGS. 3 and 4, the upper support arm 54 is provided with a supporting groove 90 which receives and supports a support roll bearing 92 which bears the radial load on the upper support roll 66. The thrust force acting on the upper support roll 66 is received by a thrust ball 94 which is disposed on one end of the support roll 66.

The end of the upper support arm 54 opposite to the engaging portion 84 constitutes a work roll supporting portion 98 which supports the upper work roll 50 through a work roll neck bearing 96 adapted to bear the radial load on the work roll. The work roll supporting portion 98 has a construction which is similar to that explained before in connection with FIG. 11. Namely, a gap 102 is left between the bottom of a recess 100 and the work roll neck bearing 96. A stopper 104 is provided on the lower wall of the recess 100, near the end of the supporting groove 90. The stopper 104 has a conical or semispherical upper end, and is urged upwardly by a spring 106, so as to retractably project into the supporting groove 90.

The embodiment having the described construction operates in a manner which will be explained hereinunder.

The upper and lower work rolls 50, 52 receive rolling reduction load applied by the upper and lower back-up rolls 72, 76 through the upper and lower intermediate rolls 70, 74, thereby effecting rolling on the rolled material W. The upper and lower work rolls 50, 52 are pressed onto the upper and lower support rolls 66, 68 by the components of the rolling load. The support rolls, therefore, effectively prevent deflection of the work rolls. Since the axes of the work roll, support rolls and the segmented roll on each side of the path of the rolled work W are on the same straight line, the horizontal forces acting on the upper and lower work rolls 50, 52 are transmitted to the upper and lower segmented rolls 58, 60 through the upper and lower support rolls 66, 68. The segmented rolls 58, 60 are carried by respective support shafts 62, 64 which are fixed to the support beam 80, so that the horizontal forces received by the work rolls are transmitted to the support beam 80 through the support shafts 62, 64. In addition, the horizontal force transmitted to the support beam 80 is transmitted to the mill housing 78 through the wedge 171 and the block 173.

The application of the bending force to the upper and lower intermediate rolls 70, 74 may be conventional, a shown in FIG. 1, with respect to bending cylinders 170.

The application of the bending force to the upper and lower work rolls 50, 52 is effected by operating the bending cylinders 86, 88. This is also the case with the lower work roll, although not illustrated. Namely, in order to apply an increase bending force to the work roll 50, the bending cylinder 88 is operated so that the rear end of the upper support arm 54 is lowered. In consequence, the end of the upper supporting arm 54 tends to rotate about the axis of the support shaft 64 counter-clockwise as viewed in the drawings, thereby applying an increasing bending force to the upper work roll 50. Conversely, for imparting a decreasing bending force to the upper work roll 50, the bending cylinder 86 is operated to rotate the upper support arm 54 clockwise.

Thus, in the illustrated embodiment, the force produced by either bending cylinder 86, 88 as the bending force generating means is transmitted to the work roll through a single support arm, whereby the construction of the bending apparatus is simplified and the size of the same is reduced. Furthermore, since the bending cylinder 86, 88 and the work rolls 50, 52 are disposed on opposite sides of the axes of rotation of the support arms 54, 56, it is possible to preserve an ample space for accommodation of the bending cylinder, thus enabling a further reduction in the diameter of the work roll.

In the illustrated embodiment of the invention, the end of the arm is notched so that the work rolls 50, 52 can easily be demounted from the support arms when roll exchange is necessary. The stopper 104 provided on the lower wall of the supporting groove effectively prevents the support rolls from coming off, when the work roll is demounted from the support arm. Since the stopper 104 is projected resiliently and retractably, the support rolls can be demounted simply by being pulled towards the end of the support arm, by a force which is greater than a predetermined level. In addition, the horizontal force received by the work roll is transmitted to the segmented roll through the bodies of the support rolls, so that only a small part of the horizontal force is born by the support roll bearings 92, whereby the support roll bearing can withstand a longer use.

Moreover, the gap 102 formed between the bottom of the recess 100 and the work roll bearing 96 received therein makes it possible to always keep the work roll in contact with the support roll, despite the reduction in the diameter of the work roll due to repeated grinding. Thus, the described embodiment affords a greater degree of freedom.

In order to prevent any change in the amount of offset of the center of the work roll attributable to the changes in the diameters of the support roll 66 and the work roll 50, the wedge 171 is moved by the actuator cylinder 172, so as to compensate for the change in the roll diameters, thereby preventing the offsetting of the axis of the work roll 50.

Figure 5:
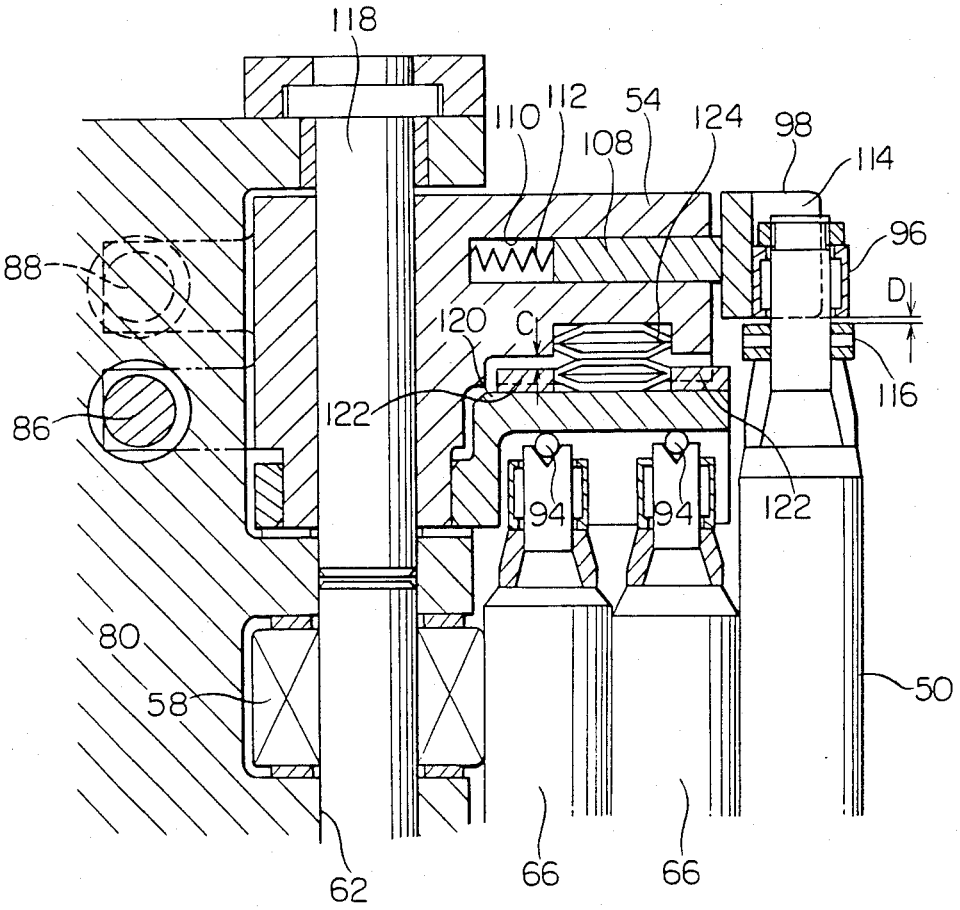
FIG. 5 is a sectional view of another embodiment of the roll bending apparatus of the invention.

FIG. 5 is a sectional view of another embodiment of the roll bending apparatus in accordance with the invention.

In this embodiment, the work roll supporting portion 98 has a construction similar to that explained in connection with FIG. 12. Namely, the work roll supporting portion 98 is provided on the rear side thereof with an insert projection 108 which is received in a hole 110 formed in the upper support arm 54, whereby the work roll supporting portion 98 is supported by the upper support arm 54. A spring 112 is loaded in the hole 110 so as to urge the work roll supporting portion 98 to the right as viewed in the drawings, whereby a recess 114 is held in close contact with the work roll neck bearing 96. A thrust bearing 116 which receives the thrust of the work roll embraces the neck portion of the work roll.

The upper support arm 54 is rockably carried by a shaft 118 which is coaxial with the support shaft 62 which rotatably carries the upper segmented roll 58. On the other hand, a support roll support member 120 is disposed at the inner side of the upper support arm 54. The support roll support member 120 is secured to the upper support arm 54 with a key 122 provided on one side thereof received in a keyway formed in the upper support arm 54.

A stopper (not shown) is provided so as to prevent the support roll support member 120 from coming off. Thus, the support roll support member 120 is rotatable together with the upper support arm 54 and is movable in the direction of the axis of the upper support roll 66. A gap C is formed between the inner surface of the upper support arm 54 and the support roll support member 120, with a disc spring 124 acting therebetween. The axes of the upper work roll 50, upper support roll 66 and the upper segmented roll 58 are disposed on a common straight line. This arrangement is also applied to the lower work roll.

In the operation of the embodiment shown in FIG. 5, the bending force is applied to the work roll in the same way as that in the embodiment shown in FIG. 1. In addition, when an excessively large thrust is applied to the upper work roll for example, the thrust is transmitted to the work roll supporting portion 98 through the thrust bearing 116. However, when there is a gap D between the work roll support portion 98 and the thrust bearing 116, the thrust force received by the upper work roll is transmitted to the thrust ball 94 through the upper support roll 66.

In general, the thrust ball 94 has only a small capacity against the thrust force, and tends to be broken when it is subjected to a large thrust force. In this embodiment, however, the disk spring 124 is compressed when the thrust ball 94 receives the thrust force, so that the support roll support member 120 is moved upward as viewed in FIG. 5. Therefore, when the size of the gap C is determined to meet the condition of $C<D$, the thrust bearing 116 comes into contact with the work roll supporting portion 98, so that most of the thrust received by the upper work roll 50 is transmitted to the work roll supporting portion 94. In consequence, only a predetermined level of thrust force necessary for compressing the disc spring 124 is applied to the thrust ball 94, whereby the thrust ball 94 is protected against any excessive load.

In this embodiment, the life of the work roll neck bearing 96 can be remarkably improved, by virtue of the fact that the work roll support portion 98 is urged by the spring 112. In addition, by constructing the work roll supporting portion 98 in a box-like form as shown in FIG. 13, it is possible not only to further prolong the life of the work roll bearing 96 but also to enhance the strength of the work roll supporting portion itself.

Although preferred embodiments have been described with specific reference to a six-stage rolling mill, it will be clear to those skilled in the art that the described embodiments are equally applicable to various types of rolling mills shown in FIGS. 6 to 10. It is also possible to arrange that the roll bending apparatus of the invention is used only for one of the upper and lower work rolls. The invention can be applied also to rolling mills which have no support roll. In such application, it is not necessary to preserve the gap between the work roll supporting portion and the work roll.

Although in the described embodiments the roll bending apparatus is used for imparting a bending force to each work roll, the apparatus of the invention is effective also in providing a balancing effect, through a suitable setting of the load.

As has been described, according to the invention, it is possible to obtain a roll bending apparatus having a simple construction, thus fulfilling the aforementioned object of the invention.

What is claimed is:

1. A roll bending apparatus for a multi-stage rolling mill, comprising:

a mill frame;

upper and lower parallel axis work rolls rotatably mounted on said frame for rolling sheet material therebetween;

upper andlower vertical support rolls mounted on said frame for rotation about respective axes parallel to said work roll axes for vertically supporting said work rolls;

horizontal support rolls mounted horizontally adjacent at least one of said work rolls for rotation about respective axes parallel to said work roll axes for supporting the respective work roll in one horizontal direction;

a pair of horizontal support arm members respectively mounting opposite axial ends of said support rolls and said one work roll;

pivot means for mounting said support arm members for rocking motion in respective substantially vertical planes about a common fulcrum axis spaced from and parallel to the axis of said one work roll;

each of said support arm members having a work roll support end ortion provided with bearing means for mounting said one work roll on said support arm member for limited horizontal lost motion and vertically fixed coupling; and bending force generating menas for applying a substantially vertical roll bending force to the ends of said support arm members opposite from said work roll support end portions and on the opposite side of said fulcrum axis from said work rolls, for rotating eachof said support arm members about said fulcrum axis to exert a vertical roll bending force on the opposite ends of sid one work roll.

2. A roll bending apparatus according to claim 1, wherein said bearing means includes a horizontal lost motion coupling and vertically fixed coupling between at least one of said horizontal support rolls and said support arm members.

3. The apparatus according to claim 2, wherein the support roll furthest removed from said work roll is a segmented roll, and the axes of said support rolls and said one work roll being in a common generally horizontal plane.

4. The apparatus of claim 3, wherein ach of said work rolls has support arm members, horizontal support rolls, mounting means and bending force generatig means that are substantially identical.

5. The apparatus of claim 2, wherein siad bearing means is an elongated U-shaped slot on each of said support arm members opening toward said one work roll for receiving therein the respective shaft ends of said one work roll and said at least one horizontal support roll; stopper detent means biased for resiliently extending radially into each slot of said support arm members between saidone work roll and said support rolls for resiliently resisting horizontal removal of said support rolls without interfering with horizontal removal of said work roll from said slots, such that said one work roll may be horizontally removed from said slots without moving said support arm members and said support rolls may thereafter be horizontally removed from said slots by overcoming the bias of said stopper detent means.

6. The apparatus of claim 2, wherein said bearing means of each of said support arm members is provided with a horizontally telescoping non-rotatable coupling between said work roll support end portion and the remainer of the corresponding support arm member for providing said limited lost motion in the horizontal direction for said one work roll.

7. The apparatus of claim 6, wherein said work roll support end portion is provided with a horizontally inwardly opening recess and said work roll is provided with rotatable bearing means on each of its ends outwardly slidably and tightly received with said said recess for preventing relative movement therebetween in the vertical direction and the outward horizontal direction.

8. The apparatus of claim 1, further including a support beam slidably carried on sai frame for relative movement in the horizontal direction, said support beam carrying thereon said support arm members, said horizontal support rolls, said one work roll, and said roll bending force generating means; and means actuatable to drive said support beam relative to the frame in the horizontal direction, for horizontally moving said support arm members, horizontal support rolls and one work roll carried thereon an amount to compensate for the offset of the center of the work rolls attributable to changes in diameters of the horizontal support rolls and one work roll thereby preventing a change in the offset of the axis of the work rolls.

9. The apparatus according to claim 1, further comprising thrust bearing means engaging each axial end of each of said work rolls.

10. The apparatus of claim 1, wherein each of said support arm members includes a support roll support member portion mounted on its respective support arm member for relative horizontal movement in the axial dirction, each support roll support member mounting a respective end of said horizontal support rolls and having a support roll thrust bearing therebetween, spring means resiliently between each support roll support member portion its respective support arm member for resiliently axialy biasing said support roll support member axially toward the adjacent horizontal support rolls to provide a support rolls thrust gap of possible relative axial movement between said support rolls and said support arm member; work roll thrust bearing means for th eopposite end of each of said one work roll providing a thrust axial work roll gap of relative movement betweensaid one work roll and said support arm members; said thrust work roll thrust gap being substantially less than said support rolls thrust gap; said support roll thrust bearing means having a thrust capacity substantially less than said work roll thrust bearing means, and said spring means having a biasing axial force substantaillly less than said support roll thrust bearing force capacity, so that axial thrust on said one work roll, as it increases, will first overcome the bias of said support roll spring means without damaging said support roll thrust bearing means until said thrust axial work roll gap is closed and thereafter be counteracted by said work roll thrust bearing.

11. The apparatus of claim 1, wherein said vertical support rolls have their axes in a common vertical plane that is horizontally spaced from the common vertical plane of said work roll axes on the opposite side of said work rolls from said support arm members and support rolls.

12. A roll bending apparatus for a multi-stage rolling mill, comprising:

a mill frame;

upper and lower parallel axis work rolls rotatably mounted on said frame for rolling sheet material therebetween;

upper and lower vertical support rolls mounted on said frame for rotation about respective axes parallel to said work roll axes for vertically supporting said work rolls;

horizontal support rolls mounted horizontally adjacent at least one of said work rolls about respective axes parallel to said work roll axes for supporting the respective work roll in one horizontal direction;

a pair of horizontal support arm members respectively mounting opposite axial ends of said support rolls and said one work roll;

pivot means for mounting said support arm members for rocking motion in respective substantially vertical planes about a common fulcrum axis spaced from and parallel to the axis of said one work roll;

each of said support arm members having a work roll support end portion provided with bearing means for mounting said one work roll on said support arm member for limited horizontal motion and vertically fixed coupling; and bending force generating means for applying a substantailly vertical roll bending force to the ends of said support arm members, for rotating each of said support arm members about said fulcrum axis to exert a vertical roll bending force on the opposite ends of said one work roll;

said bearing means includes a horizontal lost motion coupling and vertically fixed coupling between at least one of said horixontal support rolls and said support arm members; and said bearing means is an elongated U-shaped slot on each of said support arm members opening toward said one work roll for receiving therein the respective shaft ends of said one work roll and said at least one horizontal support roll; stopper detent means biased for resiliently extending radially into each slot of said support arm members between said one work roll and said support rolls for resiliently resisting horizontal removal of said support rolls without interfering with horizontal removal of said work roll from said slots, such that said one work roll may be horizontally removed from said slots without moving said support arm members and said support rolls may thereafter be horizontally removed from said slots by overcoming the bias of said stopper detent means.

13. A roll bending apparatus for a multi-stage rolling mull, comprising:

a mill frame;

upper and lower parallel axis work rolls rotatably mounted on said frame for rolling sheet material therebetween;

upper and lower vertical support rolls mounted on said frame for rotation about respective axes parallel to said work roll axes for vertically supporting said work rolls;

horizontal support rolls mounted horizontally adjacent at least one of said work rolls about respective axes parallel to said work roll axes for supporting the respective work roll in one horizontal direction;

a pair of horizontal support arm members respectively mounting opposite axial ends of said support rolls and said one work roll;

each of said support arm members having a work roll support end portion provided with means for mounting said one work roll on said support arm member;

each of said support arm members includes a support roll support member portion mounted on its respective support arm member for relative horizontal movement in the axial direction, each support roll support member mounting a respective end of said horizontal supports rolls and having a support roll thrust bearing therebetween, spring means resiliently between each support roll support member portion and its support arm member for resiliently axially biasing said support roll support member axially toward the adjacent horizontal support rolls to provide a support rolls thrust gap of posible relative axial movement beteen said support rolls and said support arm member; work roll thrust bearing means for the opposite end of each of said one work roll providing a thrust axial work roll gap of relative movement between said one work roll and said support arm members; said thrust work roll gap being substantially less than said support rolls thrust gap; said support roll thrust bearing means having a thrust capacity substantially less than said work roll thrust bearing means, and said spring means having a biasing axial force substantially less than said support roll thrust bearing force capacity, so that axial thrust on said one work roll, as it increases, will first overcome the bias of said support roll spring means without damaging said support roll thrust bearing means until said thrust axial work roll gap is closed and thereafter be counteracted by said work rol thrust bearing.

* * * * *